US006333729B1

(12) United States Patent
Ha

(10) Patent No.: US 6,333,729 B1
(45) Date of Patent: Dec. 25, 2001

(54) LIQUID CRYSTAL DISPLAY

(75) Inventor: Yong Min Ha, Kyongki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/090,950

(22) Filed: Jun. 5, 1998

(30) Foreign Application Priority Data

Jul. 10, 1997 (KR) ..... 97/32096

(51) Int. Cl.[7] ..... G09G 3/36

(52) U.S. Cl. ..... 345/98; 345/100; 345/88

(58) Field of Search ..... 345/98, 99, 100, 345/87, 88, 89, 103, 204, 205, 208, 211

(56) References Cited

U.S. PATENT DOCUMENTS

| | | | | |
|---|---|---|---|---|
| 4,571,584 | * | 2/1986 | Suzuki | 345/208 |
| 4,716,403 | * | 12/1987 | Morozumi | 345/88 |
| 4,855,724 | * | 8/1989 | Yang | 345/88 |
| 4,908,609 | * | 3/1990 | Stroomer | 345/88 |
| 4,963,860 | | 10/1990 | Stewart . | |
| 5,170,158 | | 12/1992 | Shinya . | |
| 5,771,031 | | 6/1998 | Kinoshita et al. . | |

FOREIGN PATENT DOCUMENTS

| | | |
|---|---|---|
| 0 368 572 A2 | 11/1989 | (EP) . |
| 0 546 780 A1 | 12/1992 | (EP) . |
| 0 837 446 A1 | 10/1997 | (EP) . |
| 4-52684 | 2/1992 | (JP) . |
| 5-210359 | 8/1993 | (JP) . |
| 8-211846 | 8/1996 | (JP) . |
| 10-177371 | 4/1998 | (JP) . |
| WO 94/16428 | 1/1994 | (WO) . |
| WO 94/16428 | 7/1994 | (WO) . |
| WO 95/19658 | 7/1995 | (WO) . |

OTHER PUBLICATIONS

Tanaka, T. et al., "An LDC Addressed by a Si:H TFTS With Peripheral Poly–Si TFT Circuits", International Electron Devices Meeting 1993, Technical Digest (Cat. No. 93CH3361–3), Proceedings of IEEE International Electron Devices Meeting, Washington, D.C., USA, Dec. 5–8, 1993, pp. 15.3.1–15.3.4.

S. Mamoru, "Control Board Installation Structure", Patent Abstracts of Japan, for JP Application No. 63002556, Jul. 18, 1989.

Y. Akihiko, "Projection Type Color Display Device", Patent Abstracts of Japan, for JP Application No. 63001944, Jul. 17, 1989.

T. Izumi, "Information recording and Displaying Body", Patent Abstracts of Japan, for JP Application No. 63002205, Jul. 13, 1989.

T. Kichiji, "Light Valve System Video Projecting Device and Optical Device" Patent Abstracts of Japan, for JP Application No. 63147576, Dec. 19, 19889.

Y. Akihiko, "Cooler For Projection Type Display Device", Patent Abstracts of Japan, for JP Application No. 63146291, Dec. 19, 1989.

(List continued on next page.)

*Primary Examiner*—Xiao Wu
(74) *Attorney, Agent, or Firm*—Finnegan, Henderson, Farabow, Garrett & Dunner L.L.P.

(57) ABSTRACT

A liquid crystal display apparatus time-divisionally drives data lines of a pixel matrix. The apparatus transfers output signals of at least two data driver integrated circuits to a plurality of data lines using at least two multiplexers. Further, it rearranged the video data before supplying the video data to at least two data driver integrated circuits. Accordingly, it is possible to reduce the number of the data driver integrated circuits required in the liquid crystal display apparatus and to simplify a wiring structure between the pixel matrix and the data driver integrated circuits.

40 Claims, 6 Drawing Sheets

OTHER PUBLICATIONS

M. Toshiichi et al., "Liquid Crystal Color Projector Device", Patent Abstracts of Japan, for JP Application No. 63144935, Dec. 18, 1989.

A. Junichi, "Automatic Teller Machine", Patent Abstracts of Japan, for JP Application No. 63143028, Dec. 14, 1989.

T. Tanaka et al., "An LCD addressed by a–Si:H TFTs with Peripheral Poly–Si TFT Circuits,"International Electron Devices Meeting 1993, pp. 389–392.

* cited by examiner

LIQUID CRYSTAL DISPLAY

BACKGROUND OF THE INVENTION

1. Field of the Invention

This invention relates to a liquid crystal display device employing thin film transistors ("TFTs"), used as a switch matrix, and more particularly to a liquid crystal display device adapted to be driven with digital video data.

2. Description of the Prior Art

Recently, there has been used a signal transfer system changing of an analog image signal into a digital image signal feasible to the compression of information, in order to provide the high resolution picture with a viewer. A liquid crystal display panel has been developed that may be driven with the digital image signal instead of the existing analog image signal.

An digital-type liquid crystal display apparatus based on this development, as shown in FIG. 1, comprises a gate driver 12 for driving gate lines GL of a liquid crystal display panel, and a number of data driver integrated circuit, hereinafter referred simply to as "ID-IC", for time-divisionally driving data lines DL of the liquid crystal display panel 10. In the liquid crystal display panel 10, the TFTs, although not shown, are located at in intersections of the gate lines GL with the data lines DL, and liquid crystal cells are connected to each of these TFTs. The gate driver 12 drives the gate lines GL sequentially for the horizontal scanning interval every frame period through a gate control signal. In other words, the gate driver 12 sequentially drives the TFTs included in the liquid crystal panel 10 for every one line. Further, the D-ICs 14 convert video data into analog data signals every horizontal scanning interval using a data control signal and applies the converted analog video signal to the data lines DL. Specifically, each of the D-ICs 14 input video data corresponding to its input lines and converts the input video data into analog video signals. Also, each of the D-ICs 14 supplies the analog video signals to the data lines DL connected to the output line thereof. Accordingly, liquid crystal cells for a single line connected to the TFTs for that line control the light transmissivity in accordance with a voltage level of that line.

In the digital-type liquid crystal display apparatus having a configuration described above, since the D-ICs 14 drive the data lines corresponding to their output terminal, it has a disadvantage in that a great number of D-ICs are required, and that, hence, the circuit configuration and volume becomes large.

In order to overcome such a disadvantage in the conventional digital-type liquid crystal display apparatus, there has been suggested a liquid crystal display apparatus using time division demultiplexing. Examples of this liquid crystal display apparatus of time division system include one disclosed, in an article published in the 1993 edition of the IEEE Journal, titled "An LCD Addressed by a-Si:H TFTs with Peripheral poly-Si TFT Circuit" by Tanaka et al., and an article published, through "Euro Display '96", titled "$Ar^+$ Laser Annealed Poly-Si TFT for Large Area LCDs" by Kato et al. According to these articles, the time divisional liquid crystal display apparatus improves the ON/OFF speed of TFTs by forming the TFTs to have a dual layer of a polycrystalline Si and an amorphous Si. Further, the time divisional liquid crystal display apparatus allows date lines to be time-divisionally driven by inserting a demultiplexer between output terminals of each of D-ICs and the data lines. According, the time divisional liquid crystal display apparatus could reduce a required amount of D-ICs into below half.

In the time divisional liquid crystal display apparatus, however, since the demultiplexer switches the data lines, the distance between data lines driven with a single demultiplexer becomes large. This causes a complication in the wiring arrangement of the liquid crystal display panel as well as a distortion of video signal. Also, since D-ICs have to sample video data for one line sequentially, sampling clocks with a frequency corresponding to the number of video data for one line should be supplied to the D-ICs.

SUMMARY OF THE INVENTION

Accordingly, it is an object of the present invention to provide a liquid crystal display apparatus which can simplify a circuit configuration and a wiring structure thereof.

It is other object of the present invention to provide a liquid crystal display apparatus which can retard a sampling period of video data.

In order to obtain said objects of the invention, a liquid crystal display apparatus according to an aspect of the present invention comprises: (1) a liquid crystal panel in which picture element cells are arranged at each of intersections of a plurality of data lines with a plurality of gate lines; (2) a first data driver circuit for supplying a plurality of video signals; (3) a second data driver circuit for supplying a plurality of video signals; and (4) a plurality of demultiplexing circuit each receiving a respective one of the video signals supplied from a respective one of the first and second data driver circuits and selectively outputting the respective video signals to a respective group of said plurality of data lines.

Furthermore, a liquid crystal display apparatus according to another aspect of the present invention comprises: (1) a liquid crystal panel in which red, green, and blue picture element cells are arranged at intersections of a plurality of data lines with a plurality of gate lines, the red, green, and blue picture elements being repeated in a horizontal axis thereof; (2) a first data driver circuit for supplying a plurality of video signals; (3) a second data driver circuit for supplying a plurality of video signals; and (4) a plurality of demultiplexing circuits each receiving a respective one of the video signals supplied from a respective one of the first and second data driver circuits and selectively outputting the respective video signal to a respective group of said plurality of data lines.

Furthermore, a liquid crystal display apparatus according to still another aspect of the present invention comprises: (1) a liquid crystal panel in which picture element cells are arranged at each of a plurality of intersections of n data lines with m gate lines, where n and m are positive intergers; (2) a plurality of multiplexing means, n divided by p in number, each said multiplexing means for outputting a data signal to p of the n data lines, where p is a positive integer less than n; and (3) data driver circuits, q in number, for time divisionally driving the plurality of demultiplexing means, where q is a positive integer.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
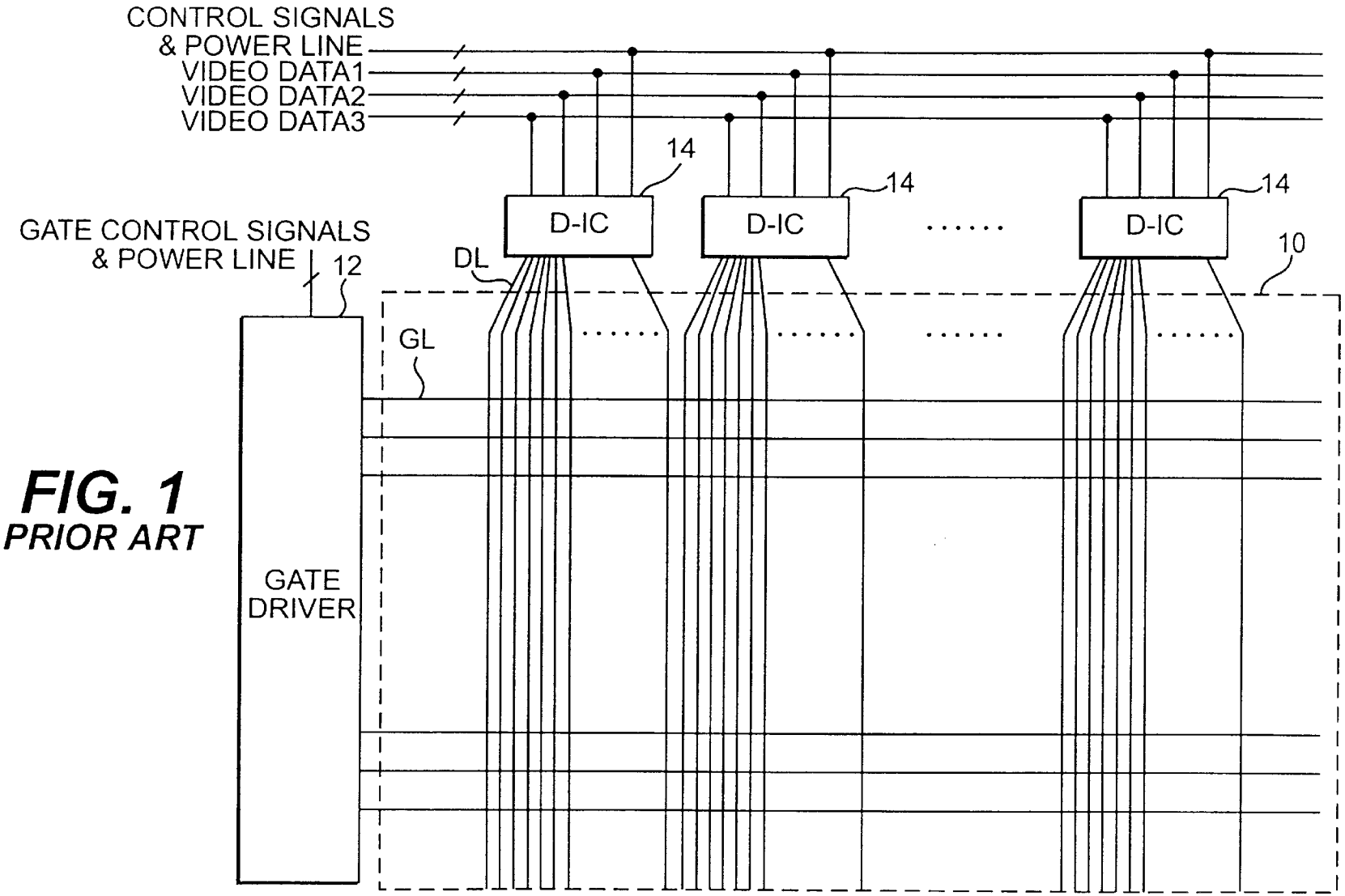
FIG. 1 PRIOR ART
FIG. 1 is a schematic view of a conventional liquid crystal display apparatus.
Figure 2:
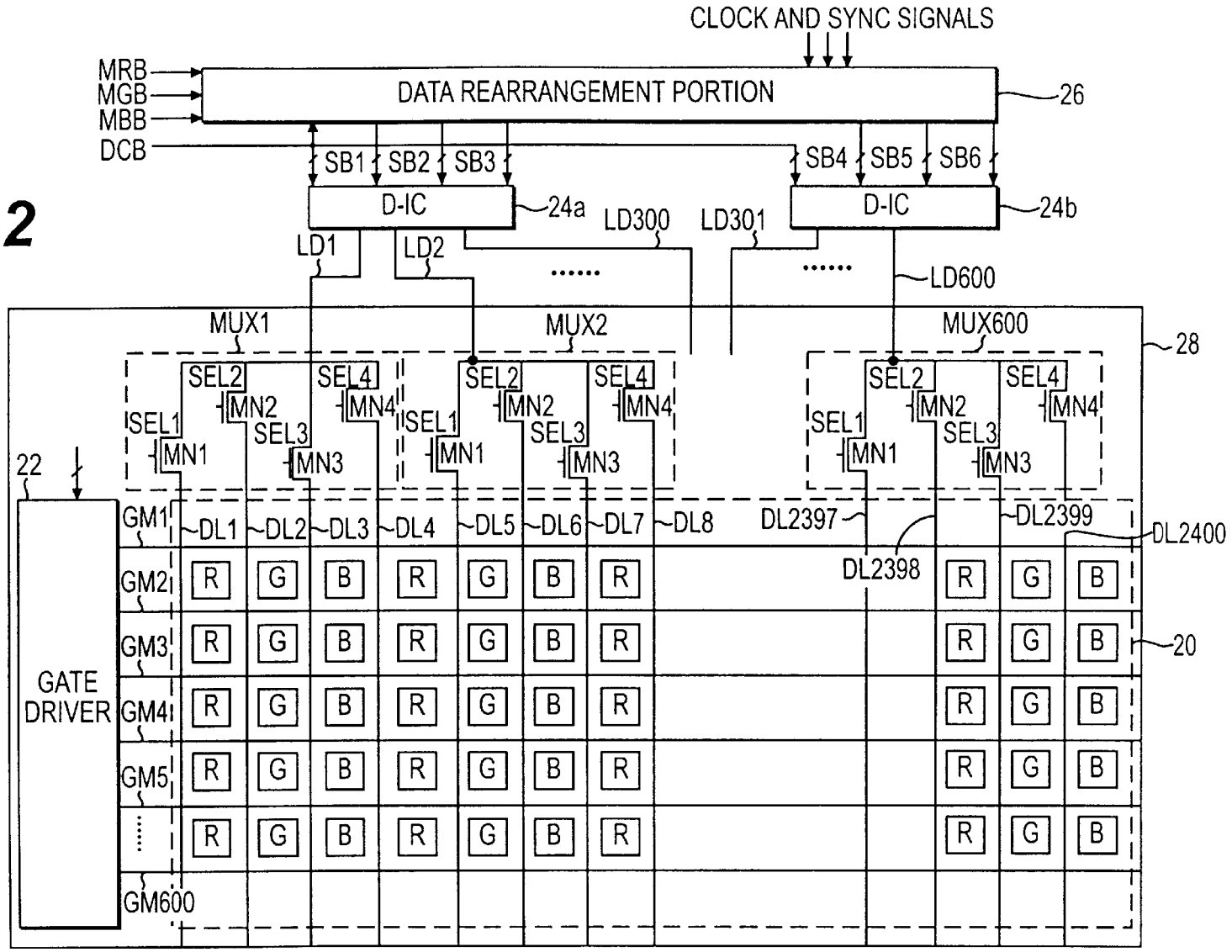
FIG. 2 is a block diagram of a liquid crystal display apparatus according to an embodiment of the present invention.

Referring to FIG. 2, there is shown a liquid crystal display apparatus according to an embodiment of the present invention comprising a gate driver 22 for driving gate lines GM1 to GM600 of a pixel matrix 20, and D-ICs 24*a* and 24*b* for driving data lines DL1 to DL2400 of the pixel matrix 20. This pixel matrix 20 includes 600×2400 picture elements, each of which is arranged in intersecting points of the gate lines GM1 to GM600 with the data lines DL1 to DL2400, to display a picture having 600×800 pixels. Each of the picture elements consists of a single TFT and a single liquid crystal cell. A gate electrode and a data electrode of the TFT included in the picture element are connected to the gate line GM and the data line DL, respectively. The 2400 data lines DL1 to DL2400 are assigned 800 groups of three pixel elements each for driving red color R elements, green color G elements, and blue color B elements in each group. These data lines for red R, green G, and blue B are alternately arranged. The gate driver 22 drives the gate lines GL sequentially for a horizontal scanning interval every frame period by using a gate control signal. By means of this gate driver 22, the TFTs included in the pixel matrix 20 are sequentially turned on to connect the 2400 data lines DL1 to DL2400 to the 2400 liquid crystal cells, respectively. In the mean time, each of the D-ICs 24*a* and 24*b* samples video data every horizontal scanning interval and converts the sampled video data into video signals. Further, each of D-ICs 24*a* and 24*b* applies the video signals to the data lines DL. Accordingly, each of the liquid crystal cells connected to the turned-on TFTs controls the light transmissivity in accordance with a voltage level of the video signal from the data line DL.

Further, the liquid crystal display apparatus includes multiplexers MUX1 to MUX600, each of which is connected to output terminals LD1 to LD600 of the D-ICs 24*a* and 24*b*. Each of these demultiplexers MUX1 to MUX600 is connected to four adjacent data lines DLi to DLi+3. Each of these demultiplexers MUX1 to MUX600 sequentially applies the video signal from the output terminal of D-IC 24 to the four data lines DLi to DLi+3 by using the first to fourth selection signals SEL1 to SEL4. To this end, each of the demultiplexers MUX1 to MUX600 includes four MOS transistors MN1 to MN4 connected between the output terminals LD of the D-ICs 24 and the four data lines DLi to DLi+3, respectively. The first to fourth selection signals SEL1 to SEL4 each have a frequency equal to the horizontal synchronous signal. Also, the first to fourth selection signals have an enabling region, that is, a high logic of region, which is progressed sequentially and repeatedly with, respect to each other. Accordingly, the four MOS transistors MN1 to MN4 included in the demultiplexer MUX are sequentially turned on every horizontal scanning interval, thereby allowing the four data lines DLi to DLi+3 to be sequentially connected to the output terminal LD of the D-IC 24. These four MOS transistors MN1 to MN4 may be replaced by circuit devices with a function of switch. The demultiplexers MUX1 to MUX600 is formed on the same glass substrate 28 along with the pixel matrix 20 and the gate driver 22. Preferably, the demultiplexers MUX1 to MUX600 is positioned above the pixel matrix 20, that is, at the upper edge of the glass substrate 28 while the gate driver 22 is positioned at the edge of the pixel matrix 20, that is, at the edge of the glass substrate 28. D-ICs 24*a* and 24*b* may be provided on the same integrated circuit as glass substrate 28 or on a separate integrated circuit.

Furthermore, the liquid crystal display apparatus is provided with a data rearrangement portion 26 which rearranges video data and applies the rearranged video data to the D-ICs 24*a* and 24*b*. This data rearrangement portion 26 separates a red data R stream, a green data G stream, and a blue data B stream input via a bus for red MRB, a bus for green MGB and a bus for blue MBB, respectively, into groups. For two D-ICs 24, two data groups are formed, and then data group is rearranged into four sections, corresponding to the number of output lines of demultiplexer MUX. Data rearrangement portion 26 supplies the rearranged video data to the D-ICs 24*a* and 24*b*. A video data is supplied, via the first to third support buses SB1, SB2 and SB3, to the first D-IC 24*a* by the three symbol unit while a video data is supplied, via the fourth to sixth support buses SB4, SB5 and SB6, to the second D-IC 24*b*, by the three symbol units. The data rearrangement portion 26 can be designed to input the video data simultaneously or to input the video data alternately. Finally, the data rearrangement portion 26 and the D-ICs 24*a* and 24*b* are controlled by a data control signal including a sampling clock input from a data control bus DCB.

Figure 3:
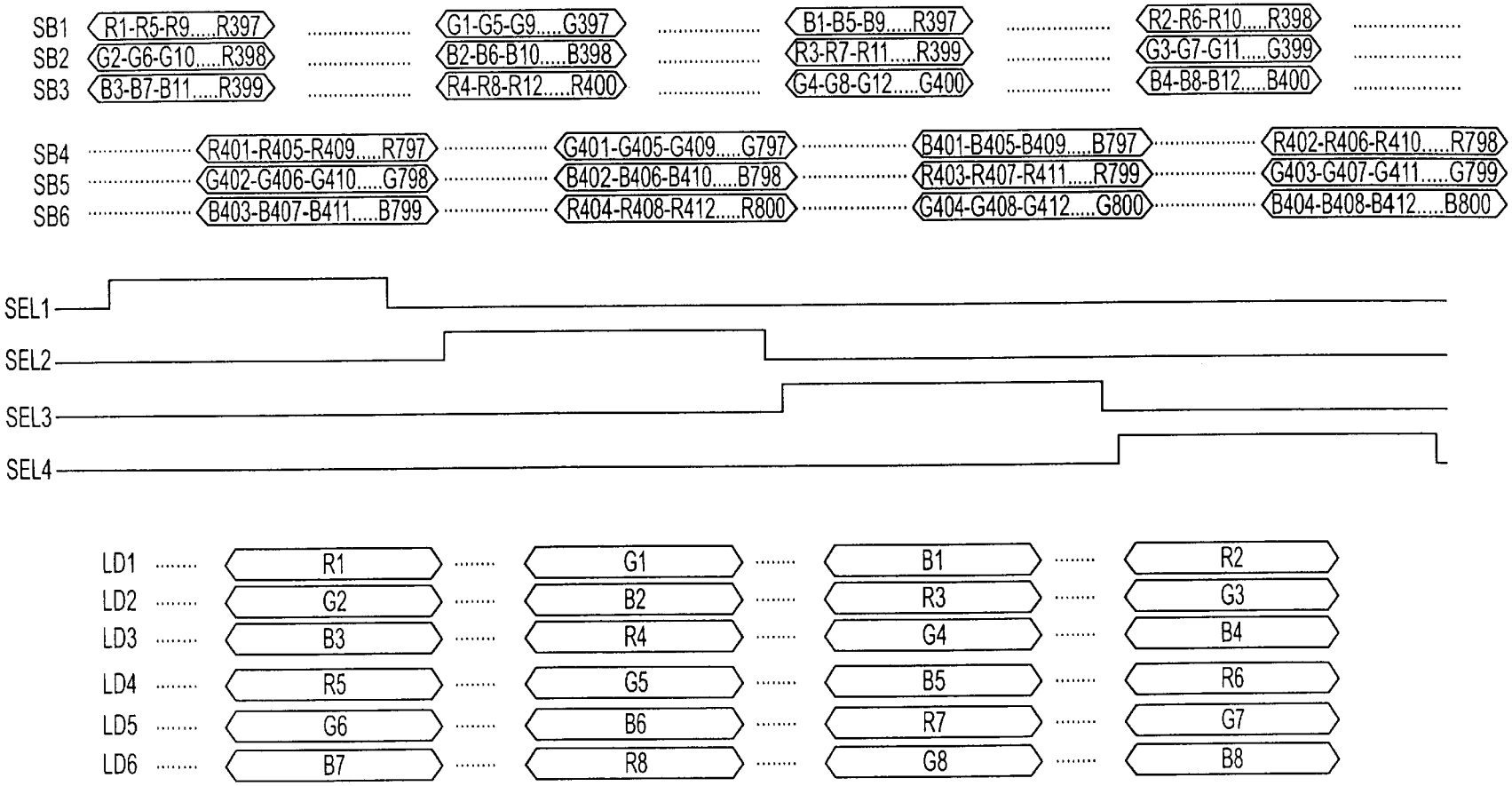
FIGS. 3 and 4 are a waveform diagram representing an operation in each part of the circuit shown in FIG. 2.

FIG. 3 is a timing diagram of an operational waveform of the data control arrangement portion 26, the D-ICs 24 and the demultiplexers MUX1 to MUX600, in the case where the video data from the data rearrangement portion 26 are alternately output to the first to third support buses SB1 to SB3 and the fourth to sixth support buses SB4 to SB6. In FIG. 3, the video data stream is alternately rearranged and the rearranged video data are applied to the D-ICs 24 through the first to sixth support buses SB1 to SB6. Specifically, the rearranged video data of "R1, R5, R9, . . . , R397" (where R1 represents the red component of the first pixel; R2 the red component of the second pixel, etc.) are supplied to the first support bus SB1, the rearranged video data of "G2, G6, G10, . . . , G398" to the second support bus SB2, and the rearranged video data of "B3, B7, B11, . . . , B399" to the third support bus, SB3, respectively. After the rearranged video data are supplied to the first to third support buses SB1 to SB3, the rearranged video data of "R401, R405, R409, . . . , R797", are supplied to the fourth support bus SB4, the rearranged video data of "G402, G406, G410, . . . , G798" to the fifth support bus SB5, and the rearranged video data of "B403, B407, B411, . . . , B799" to the sixth support bus SB6, respectively.

In a similar manner, the arranged video data are supplied to the first to sixth support buses SB1 to SB6 repeatedly within a constant interval. At this time, the rearranged data of "G1, G5, G9, . . . G397", "B1, B5, B9, . . . , 397" and "R2, R6, R10, . . . , R398" are sequentially supplied to the first support bus SB1, within a constant interval. Also, the rearranged data of "B2, B6, B10, . . . , B398", "R3, R7, R11, . . . , R399" and "G3, G7, G11, . . . , G399" are sequentially supplied to the second support bus SB2 and the rearranged data of "R4, R8, R12, . . . , R400","G4, G8, G12, . . . , G400" and "B4, B8, B12, . . . , 400" to the third support bus SB3, respectively, within a constant interval. Further, the rearranged video data of "G401, G405, G409, . . . , G797", "B401, B405, B409, . . . , B797" and "R402, R406, R410, . . . , R798", the rearranged video data of "B402, B406, B410, . . . , B798", "R403, R407, R411, . . . , R799" and "G403, G407, G411 . . . G799", and the rearranged video data of "R4, R8, R12, . . . , R400", "G4, G8, G12, . . . , G400" and "B4, B8, B12, . . . , B400" are supplied to the fourth to sixth support buses SB4 to SB6, respectively, which input video data rearranged in such a manner to be alternated with the first to third support buses SB1 to SB3.

When the selection signals SEL1 to SEL4 are sequentially enabled, that is, have a high logic, four video signals are sequentially output to each of 600 output lines LD1 to LD600 of the D-ICs 24*a* and 24*b* during one horizontal scanning interval 1H. For example, video signals of "R1, G1, B1 and R2" are sequentially output to the first output terminal LD1 of the D-ICs 24*a,* and video signals of "G2, B2, R3 and G3" are sequentially outputted to the second output terminal LD2 opf the D-IC 24*a.* In this manner, video signals of "B3, R4, G4 and B4", video signals of "R5, G5, B5 and R6", video signals of "G6, B6, R7 and G7" and video signals of "B7, R8, G8 and B8" are supplied to the third to sixth output terminals LD3 to LD6 of the D-IC 24*a,* respectively.

The 2400 video signals output to the 600 output terminals LD1 to LD600 of the D-ICs 24*a* and 24*b* over four selection signal periods are respectively applied to the 2400 data lines DL1 to DL2400 through the 600 demultiplexers MUX1 to MUX600, which perform a switching operation in accordance with the first to fourth selection signals SEL1 to SEL4. As a result, the number of D-ICs used for driving the pixel matrix 20 is reduced remarkably, for example, from eight to two.

Figure 4:
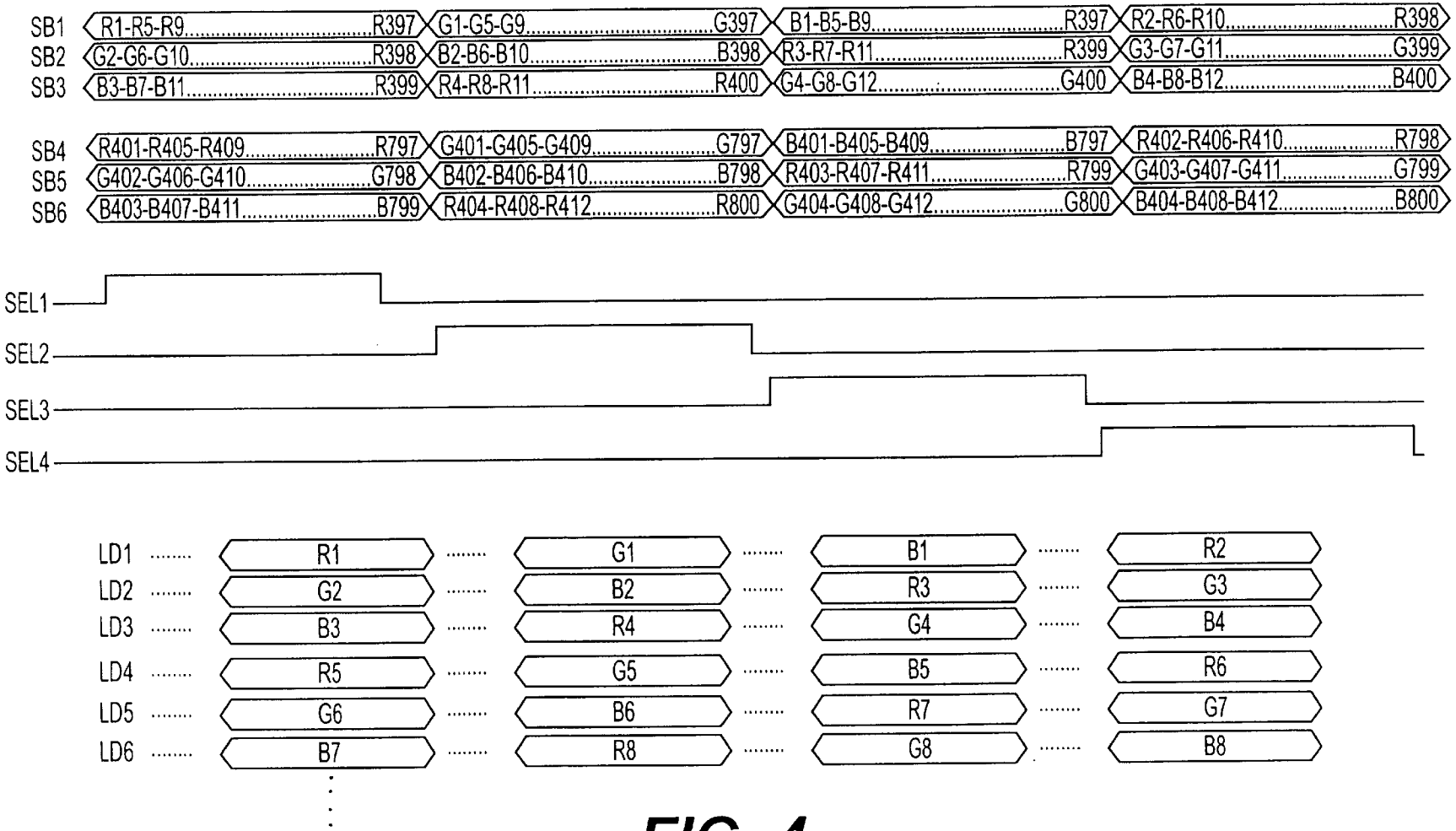

FIG. 4 shows timing diagrams of waveforms of the data rearrangement portion 26, the D-ICs 24 and the demultiplexers MUX1 to MUX600 in the case where the rearranged video data from the data rearrangement portion 26 are output to the first to third support buses SB1 to SB3 and the fourth to sixth support buses SB4 to SB6 simultaneously. In FIG. 4, the rearranged video data supplied to the first to third support buses SB1 to SB3 and the fourth to sixth support buses SB4 to SB6, respectively, so that the rearranged video date are sampled by the D-ICs 24. Specifically, the rearranged video data of "R1, R5, R9, . . . , R397", "G1, G5, G9, . . . , G397", "B1, B5, B9, . . . , B397" and "R2, R6, R10, . . . , R398" are sequentially supplied to the first support bus SB1. As shown in FIG. 4, the rearranged video data is similarly applied to the second to sixth support buses SB2 to SB6, respectively.

Subsequently, as the selection signals SEL1 to SEL4 are sequentially enabled, that is, as SEL1 to SEL4 are set to a high logic, four video signals are sequentially output to each of 600 output lines LD1 to LD600 of the D-ICs 24*a* and 24*b.* For example, video signals of "R1, G1, B1 and R2" are sequentially output to the first output terminal LD1 of the D-IC 24*a,* and video signals of "G2, B2, R3 and G3" are sequentially output to the second output terminal LD2 of the D-IC 24*a.* In this manner, video signals of "B3, R4, G4 and B4", video signals of "R5, G5, B5 and R6"', video signals of "G6, B6, R7 and G7" and video signals of "B7, R8, G8 and B8" are supplied to the third to sixth output terminals LD3 to LD6 of the D-ICs 24*a,* respectively.

The 2400 number of video signals output to the 600 output terminals LD1 to LD600 of the D-ICs 24*a* and 24*b* are respectively applied to the 2400 data lines DL1 to DL2400 by means of the 600 demultiplexers MUX1 to MUX600 performing the switching operation in accordance with the first to fourth selection signal SEL1 to SEL4. As a result, the number of D-ICs used for driving the pixel matrix 20 is reduced, for example, from eight to two. Moreover, the video data are simultaneously supplied, to the D-ICs 24*a* and 24*b,* thereby lowering the frequency of a sampling clock which is supplied to the D-ICs 24*a* and 24*b* for sampling the video data.

Figure 5:
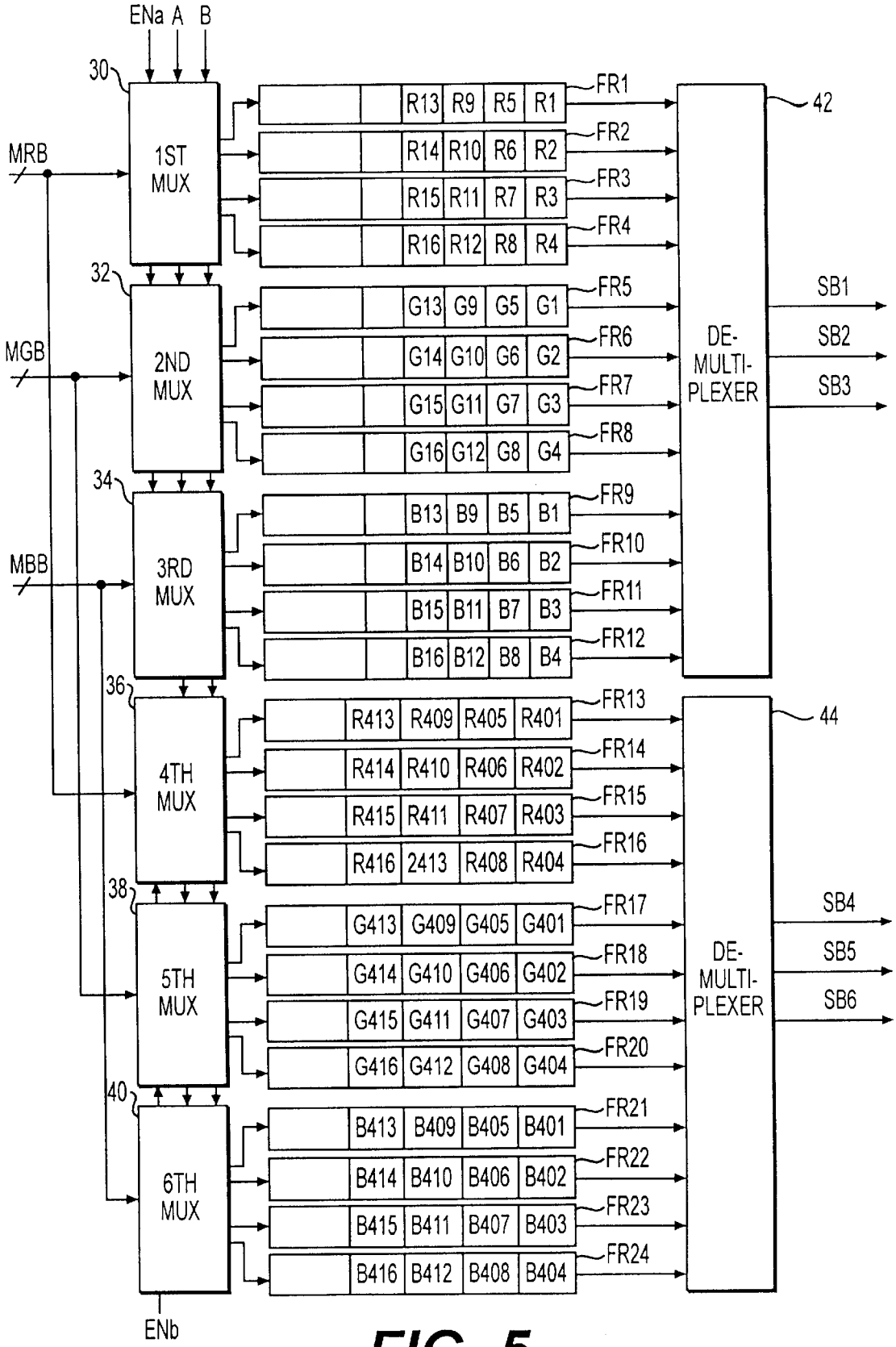
FIG. 5 is a detailed block diagram of an embodiment of the data rearrangement portion shown in FIG. 2.

FIG. 5 is a detailed block diagram of an embodiment of the data rearrangement portion 26 shown in FIG. 2. Referring to FIG. 5, the data rearrangement portion 26 comprises first to third data multiplexers 30, 32 and 34, connected to buses MRB, MGB and MBB for red, green, and blue data, respectively, and first to 12th first-input-first-output devices FR1 to FR12, hereinafter referred simply as to "FIFO", connected in parallel to the first to third data multiplexers 30, 32 and 34 in groups of four. The first to third data multiplexers 30, 32 and 34 are driven when the first division enabling signal ENa remains at a high logic, that is, during a period corresponding to half the horizontal scanning interval. The first data multiplexer 30 sequentially and repeatedly stores 400 red data R1 to R400 corresponding to half the red data stream R1 to R800 from the bus for red MRB to the first to fourth FIFOs FR1 to FR4, in accordance with logical values of 2 bit of selection signals A and B changing sequentially and repeatedly. As a result, the red data of "R1,R5,R9 . . . R397", "R2,R6,R10 . . . R398", "R3,R7,R11 . . . R399" and "R4,R8,R12 . . . R400" are stored to the first to fourth FIFOs FR1 to FR4, respectively. Similar to the first data multiplexer 30, the second multiplexer 32 sequentially and repeatedly stores 400 green data G1 to G400 corresponding to half the green data stream G1 to G800 from the bus for green MGB to the fifth to eighth FIFOs FR5 to FR8, in accordance with logical values of selection signals A and B changing sequentially and repeatedly. As a result, the green data of "G1,G5,G9 . . . G397", "G2,G6,G10 . . . G398", "G3,G7,G11 . . . G399" and "G4,G8,G12 . . . G400" are stored in the fifth to eighth FIFO FR5 to FR8, respectively. Further, similar to the first and second data multiplexers 30 and 32, the third data multiplexer 34 sequentially and repeatedly stores 400 blue data B1 to B400 corresponding to half the blue data stream B1 to B800 from the bus for blue MBB to the ninth to 12th FIFOs FR9 to FR12, in accordance with logical values of said two-bit of selection signals A and B changing sequentially and repeatedly. As a result, the blue data of "B1,B5,B9 . . . B397", "B2,B6,B10 . . . B398", "B3,B7,B11 . . . B399" and "B4,B8,B12 . . . B400" are stored in the ninth to twelfth FIFOs FR9 to FR12, respectively.

Fourth to sixth data multiplexers 36, 38 and 40 are connected to the red, green, and blue buses MRB, MGB and MBB, respectively and, at the same time, to the first to third data multiplexer 30, 32 and 34 in parallel, respectively. 13th to 24th FIFOs FR13 to FR24 are connected to the fourth to sixth data multiplexers 36, 38 and 40. The fourth to sixth data multiplexers 36, 38 and 40 are driven when the second division enabling signal ENb remains at a high logic, that is, during a period corresponding to the second half of the horizontal scanning interval when the first to third data multiplexers 30, 32 and 34 are not driven. The fourth data multiplexer 36 sequentially and repeatedly stores 400 red data R401 to R800 corresponding to half the red data stream R1 to R800 from the red bus MRB to the 13th to 16th FIFOs FR13 to FR16, in accordance with logical values of selection signals A and B. As a result, the red data of "R401,R405, R409 . . . R797", "R402,R406,R410 . . . R798", "R403, R407,R411 . . . R799" and "R404,R40,R412 . . . R800" are stored to the 13th to 16th FIFOs FR13 to FR16, respectively. Further, the fifth multiplexer 38 sequentially and repeatedly stores 400 green data G401 to G800 corresponding to half of the green data stream G1 to G800 from the green bus MGB to the 17th to 20th FIFOs FR17 to FR20, in accordance with logical values of selection signals A and B. As a result, the green data of "G401,G405,G409 . . . G797", "G40,G406, G410 . . . G798", "G403,G407,G411 . . . G4799" and "G404,G408,G412 . . . G800" and stored to the 17th to 20th FIFOs FR17 to FR20, respectively. Furthermore, the sixth data multiplexer 40 sequentially and repeatedly stores 400 blue data B1 to B400 corresponding to half the blue data stream B1 to B800 from the blue bus MBB to 21st to 24th FIFOs FR21 to FR24, in accordance with logical values of said selection signals A and B. As a result, the blue data of "B401,B405,B409 . . . B797", "B402,B406,B410 . . . B798", "B403,B407,B411 . . . B799" and "B404,B498,B412 . . . B800" are stored in the 21st to 24th FIFOs FR21 to FR24, respectively.

Moreover, the data rearrangement portion 26 further comprises the first demultiplexer 42 for inputting the video data from FIFOs FR1 to FR12, and the second demultiplexer 44 for inputting the video data from FIFOs FR13 to FR24. These first and second demultiplexers 42 and 44 are alternately driven once every interval in which respective selection signals SEL1 to SEL4 are enabled. For example, the first demultiplexer 42 is driven in the first half of the enabled interval of the first selection signal SEL1 while the second demultiplexer 44 is driven in the second half of the enabled interval of the first selection signal SEL1. Accordingly, the respective first and second demultiplexers 42 and 44 are alternately driven four times as the first to fourth selection signals are sequentially enabled, to thereby output video data of a signal horizontal line via the first to sixth support buses SB1 to SB6. Further, the respective first and second demultiplexers 42 and 44 select the video data stored in three FIFOs in the 12 FIFOs FR1 to FR12 or FR13 to FR24, whenever it is driven, and outputs the selected video data to three support buses SB1 to SB3 or SB4 to SB6, respectively. Specifically, the first demultiplexer 42 supplies the red data of "R1,R5,R9 . . . R397" from the first FIFO FR1, the green data of "G2,G6,G10 . . . G398" from the sixth FIFO FR6 and the blue data of "B3,B7,B11 . . . B399" from the 11th FIFO FR11 to the first to third support buses SB1 to SB3, respectively, when it is driven for the first time. Further, when the first demultiplexer 42 is driven for the second time, it supplies the green data of "G1,G5,G9 . . . G397" from the fifth FIFO FR5, the blue data of "B2,B6,B10 . . . B398" from the tenth FIFO FR10 and the red data of "R4,R8,R12 . . . R400" from the fourth FIFO FR4 to the first to third support buses SB1 to SB3, respectively. Furthermore, when the first demultiplexer 42 is driven for the third time, it supplies the blue data of "B1,B5,B9 . . . B397" from the ninth FIFO FR9, the red data of "R3,R7,R11 . . . R399" from the second FIFO FR2 and the green data of "G4,G8,G12 . . . G400" from the eighth FIFO FR8 to the first to third support buses SB1 to SB3, respectively. Furthermore, when the first demultiplexer 42 is driven for the fourth time, it supplies the red data of "R2,R6,R10 . . . R398" from the second FIFO FR2, the green data of "G3,G7,G11 . . . G399" from the seventh FIFO FR7 and the blue data of "B4,B8,B12 . . . B400" from the 12th FIFO FR12 to the first to third support buses SB1 to SB3, respectively.

On the other hand, the second demultiplexer 44 supplies the red data of "R401,R405,R409 . . . R797" from FIFO FR13, the green data of "G402,G406,G410 . . . G498" from FIFO FR18 and the blue data of "B403,B407,B411 . . . B799" from FIFO FR23 to the fourth to sixth support buses SB4 to SB6, respectively, when it is driven for the first time. Further, when the second demultiplexer 44 is driven for the second time, it supplies the green data of "G401,G405,G409 . . . G797" from FIFO FR17, the blue data of "B402,B406,B410 . . . B798" from FIFO FR22 and the red data of "R404,R408,R412 . . . R800" from FIFO FR16 to the fourth to sixth support buses SB4 to SB6, respectively. Furthermore, when the second demultiplexer 44 is driven for the third time, it supplies the blue data of "B401,B405,B409 . . . B797" from FIFO FR21, the red data of "R403,R407,R411 . . . R799" from FIFO FR14 and the green data of "G404,G408,G412 . . . G800" from FIFO FR20 to the fourth to sixth support buses SB4 to SB6, respectively. Furthermore, when the second demultiplexer 44 is driven for the fourth time, it supplies the red data of "R402,R406,R410 . .. R798" from FIFO FR14, the green data of "G403,G407,G411 . . . G799" from FIFO FR19 and the blue data of "B404,B408,B412 . . . B800" from FIFO FR24 to the fourth to sixth support buses SB4 to SB6, respectively.

Herein, the first to third data multiplexers 30, 32 and 34 constitute the first group rearrangement means rearranging a portion of the video data stream for one line along with the first to 12th FIFOs FR1 to FR12 and the first demultiplexer 42, and the fourth to sixth data multiplexers 36, 38 and 40 constitute the second group rearrangement means rearranging a portion of the video data stream for one line along with the 13th to 24th FIFOs FR13 to FR24 and the second demultiplexer 44. The number of these group rearrangement means requires as many as the number of D-ICs 24 shown in FIG. 2. The number of FIFOs connected to each of the data multiplexers requires as many as the number of the output lines of multiplexers MUX shown in FIG. 2. Further, the total storage capacity of FIFOs FR1 to FR24 should be at least large enough to store one line of video data, but preferably should be established such that it can store video data for two lines. Also, in the case where the total storage capacity of FIFOs FR1 to FR24 is established to store video data for two lines, the first and second demultiplexers 42 and 44 can be simultaneously driven. Accordingly, in order to control data sampling, it becomes possible to lower the frequency of the sampling clock supplied for the D-ICs 24 shown in FIG. 2.

Figure 6:
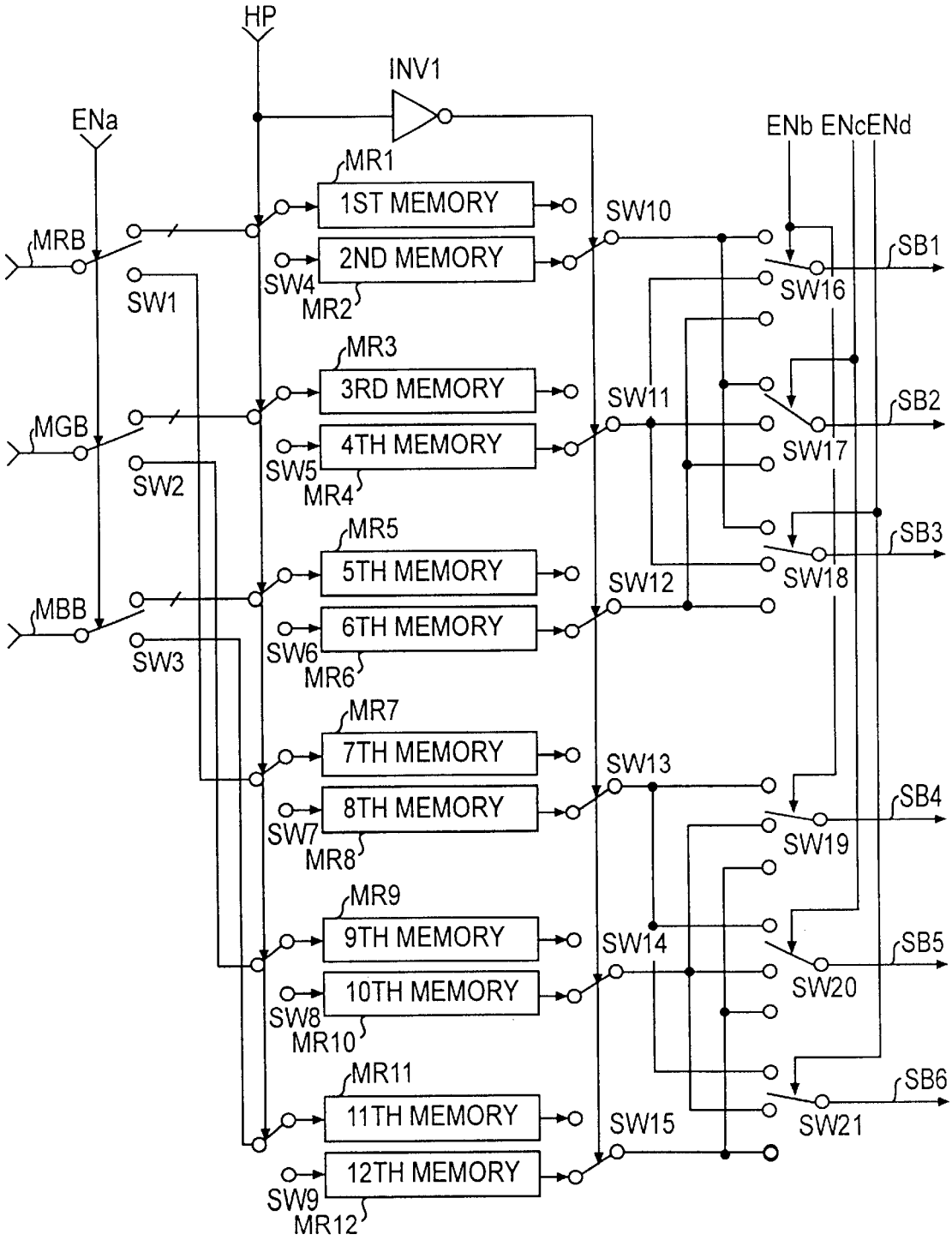
FIG. 6 is a detailed block diagram of a second embodiment of the data rearrangement portion shown in FIG. 2.

FIG. 6 is a detailed block diagram of other embodiment of the data rearrangement portion 26 shown in FIG. 2. Referring to FIG. 6, the data rearrangement portion 26 comprises first to ninth control switches SW1 to SW9 for multiplexing the video data from the red, green and blue buses MRB, MGB and MBB to the first to 12th memories MR1 to MR12. Each of the first to 12th memories MR1 to MR12 has storage capacity to store color data corresponding to half the color data for one line.

The first control switch SW1 delivers the red data stream from the red bus MRB into one side of the fourth control switch SW4 and the seventh control switch SW7 in accordance with a logical state of the first switching control signal ENa. The first switching control signal ENa remains at a high logic in a period corresponding to the first half of the horizontal scanning interval while at a low logic in a period corresponding to the second half. By this first switching control signal ENa, the first control switch SW1 delivers 400 red data R1 to R400 in the first half of the red data R1 to R800 for one line into the fourth control switch SW4 while 400 red data R401 to R800 in the second half thereof into the seventh control switch SW7. Likewise, the second control switch SW2 delivers 400 green data G1 to G400 in the first half of the green data G1 to G800 for one line from the green bus MGB into the fifth control switch SW5 while 400 green data G401 to G800 in the second half thereof into the eighth control switch SW8, by the first switching control signal ENa. Similar to the first and second control switches SW1 and SW2, the third control switch SW3 delivers 400 blue data B1 to B400 in the first half of the blue data B1 to B800 for one line from the blue bus MBB into the sixth control switch SW6 while 400 blue data B401 to B800 in the second half thereof into the ninth control switch SW9, by the first switching control signal ENa.

The respective fourth to ninth control switches SW4 to SW9 deliver color data into any one side of the odd number memories and the even number memories in accordance with a logical state of a horizontal synchronous pulse HP. This horizontal synchronous pulse HP changes from a high logic into a low logic and vice versa every time period of the horizontal synchronous signal. As a result, the respective fourth to ninth control switches SW4 to SW9 deliver the color data into the odd number memories during the odd number horizontal synchronous interval, and deliver the color data into the even number memories during the even number horizontal synchronous interval. Specifically, in the course of the odd number horizontal synchronous interval, the fourth control switch SW4 delivers the red data of "R1 to R400" into the first memory MR1, the fifth control switch SW5 the green data of "G1 to G400" into the third memory MR3, the switch control switch SW6 the blue data of "B1 to B400" into the fifth memory MR5, the seventh control switch SW7 the red data of "R401 to R800" into the seventh switch MR7, the eighth control switch SW8 the green data of "G401 to G800" into the ninth memory MR9, and the ninth control switch SW9 the blue data of "B401 to B800" into the 11th memory MR11. On the other hand, in the course of the even number synchronous interval, the fourth control switch SW4 delivers the red data of "R1 to R400 into the second memory MR2, the fifth control switch SW5 the green data of "G1 to G400" into the fourth memory MR4, the sixth control switch SW6 the blue data of "B1 to B400" into the sixth memory MR6, the seventh control switch SW7 the red data of "R401 to R800" into the eighth memory MR8, the eighth control switch SW8 the green data of "G401 to G800" into the tenth memory MR10, and the ninth control switch SW9 the blue data of "B401 to B800" into the 12th memory MR12.

In the mean time, the first to 12th memories MR1 to MR12 read out and output the stored color data in a different sequence from the input sequence. Further, the first, third and fifth memories MR1, MR3 and MR5 perform the read-out operation simultaneously with the seventh, ninth and 11th memories MR7, MR9 and MR11, and the second, fourth and sixth memories MR2, MR4 and MR6 perform the read-out operation simultaneously with the eighth, tenth and 12th memories MR8, MR10 and MR12. At the time of reading out data, the first and second memories MR1 and MR2 output 400 red data R1 to R400 in a sequence of "R1,R5,R9 . . . R397", "R4,R8,R12 . . . R400", "R3,R7,R11 . . . R399" and "R2,R6,R10 . . . R398". In similarity to the first and second memories MR1 and MR2, the seventh and eighth memories MR7 and MR8 output 400 red data R401 to R800 in a sequence of "R401,R405,R409 . . . R797", "R404,R408,R412 . . . R400", "R403,R407,R411 . . . R799" and "R402,R406,R410 . . . R798". Further, at the time of reading out data, the third and fourth memories MR3 and MR4 output 400 green data G1 to G400 in a sequence of "G2,G6,G10 . . . G398", "G1,G5, G9 . . . G397", "G4,G8,G12 . . . G400" and "G3,G7,G11 . . . G399". Likewise, the ninth and tenth memories MR9 and MR10 output 400 green data G401 to G800 in a sequence of "G402,G406,G410 . . . G498", "G401,G405,G409 . . . G797", "G404,G408,G412 . . . G800" and "G403,G407, G411 . . . G799". At the time of reading out data, the fifth and sixth memories MR5 and MR6 output 400 blue data B1 to B400 in a sequence of "B3,B7,B11 . . . B399", "B2,B6, B10 . . . B398", "B1,B5,B9 . . . B397" and "B4,B8,B12 . . . B400". In similarity to the fifth and sixth memories MR5 and MR6, the 11th and 12th memories MR11 and MR12 output 400 blue data B401 to B800 in a sequence of "B403,B407,B411 . . . B799", "B402,B406, B410 . . . B798", "B401,B405,B409 . . . B797" and "B404,B408,B412 . . . B800".

Furthermore, the data rearrangement portion 26 includes the tenth to 15th control switches SW10 to SW15 for selectively outputting color data from the odd number memories MR1, MR3, MR5, MR7, MR9 and MR11 and color data from the even number memories MR2, MR4, MR6, MR8, MR10 and MR12. These tenth to 15th control switches SW10 to SW15 select the color data from either the odd number or the even number memories in accordance with a logical state of the horizontal synchronous pulse HP inverted by means of an inverter INV1. In other words, the tenth to 15th control switches SW10 to SW15 select the color data from the even number memories during odd number horizontal synchronous intervals while the color data from the odd number memories during even number horizontal synchronous intervals.

Furthermore, the data rearrangement portion 26 includes the 16th to 18th control switches SW16 to SW18 driven with the second to fourth switching control signals ENb, ENc and ENd, respectively. Also, the data rearrangement portion 26 further comprises the 19th to 21st control switches driven with the second to fourth switching control switches ENb, ENc and ENd, respectively. Each of these second to fourth switching control signals ENb, ENc and ENd consists of a two bit logical signal, and the logical value thereof changes four times in the same interval during a single horizontal synchronous period as the first to fourth selection signals SEL1 to SEL4 are sequentially enabled. Accordingly, the 16th to 21st control switches SW16 to SW21 becomes to be switched four times during one horizontal synchronous interval. Specifically, the 16th control switch SW16 sequentially selects the tenth control switch SW10, the 11th control switch SW11, the 12th control switch SW12 and the tenth control switch SW10 in accordance with a logical value of the second switching control signal ENb, to thereby output the rearrangement data of "R1,R5,R9 . . . R397", "G1,G5,G9 . . . G397", "B1,B5,B9 . . . B397" and "R2,R6, R10 . . . R398" to the first support bus SB1. The 17th control switch SW17 sequentially selects the 11th control switch SW11, the 12th control switch SW12, the 10th control switch SW10 and the 11th control switch SW11 in accordance with a logical value of the third switching control signal ENc, to thereby output the rearrangement data of "G2,G6,G10 . . . G398", "B2,B6,B10 . . . G398", "R3,R7, R11 . . . R399" and "G5,G7,G11 . . . G399" to the second support bus SB2. The eighth control switch SW18 sequentially selects the 12th control switch SW12, the tenth control switch SW10, the 11th control switch SW11 and the 12th control switch SW12 in accordance with a logical value of the fourth switching control signal ENd, to thereby output the rearrangement data of "B3,B7,B11 . . . B399", "R4,R8, R12 . . . R400", "G4,G8,G12 . . . G400" and "B4,B8,B12 . . . B400" to the third support bus SB3. Furthermore, the rearranged video data outputted to the fourth to sixth support buses SB4 to SB6 by means of the 19th to 21st control switches SW19 to SW21 operating in the same manner as the 16th to 18th control switches SW16 to SW18 are as follows. The rearranged video data of "R401,R405,R409 . . . R797", "G401,G405, G409 . . . G797","B401,B405,B409 . . . B797"and"R402, R406,R410 . . . R798" are supplied to the fourth support bus SB4, the rearranged video data of "G402,G406,G410 . . . G798", "B402,B406,B410 . . . B798","R403,R407,R411...R799"and"G403,G407,G411... G799" to the fifth support bus SB5, and the rearranged video data of "B403,B407,B411 . . . B499", "R404,R408,R412 . . . R800", "G404,G408,G412 . . . G800" and "B404,B408, B412 . . . B800" to the sixth support bus SB6.

As described above, a liquid crystal display apparatus can rearrange video data for one line in such a manner to sequentially drive the adjacent TETs in FETs for one line on the liquid crystal panel and, at the same time, can distribute TFTs driven simultaneously. Accordingly, in the liquid crystal display apparatus, it is possible to simplify a wiring structure between the D-ICs and the pixel matrix. Also, the present invention allows the D-ICs to sample the video data simultaneously so that the D-ICs can use the frequency of the sampling clock with a low frequency.

Although the present invention has been explained by the embodiments shown in the drawing hereinbefore, it should be understood to the ordinary skilled person in the art that the invention is not limited to the embodiments, but rather than that various changes or modifications thereof are possible without departing from the spirit of the invention. Accordingly, the scope of the invention shall be determined only by the appended claims and their equivalents.

What is claimed is:

1. A liquid crystal display apparatus, comprising:

a liquid crystal panel in which picture element cells are arranged at each of a plurality of intersections of a plurality of data lines with a plurality of gate lines;

a first data driver circuit for supplying a plurality of video signals;

a second data driver circuit for supplying a plurality of video signals;

rearrangement means for rearranging a stream of input video data and supplying the stream of rearranged input video data to the first and second data driver circuits, the stream of input video data being different than the stream of the rearranged input video data; and a plurality of demultiplexing circuits each receiving a respective one of the video signals supplied from a respective one of the first and second data driver circuits and selectively outputting the respective video signals to a respective group of said plurality of data lines.

2. A liquid crystal display apparatus as set forth in claim 1, wherein the rearrangement means supplies the rearranged input video data to the first and second data driver circuits via first and second data paths each individually connected to said first and second data driver circuits, respectively.

3. A liquid crystal display apparatus as set forth in claim 2, wherein the rearranged input video data on the firth path is in a mutually exclusive relationship with the rearranged input video data on the second path.

4. A liquid crystal display apparatus as set forth in claim 2, wherein said firth and second data paths are simultaneously fed with the rearranged input video data from said rearrangement means.

5. A liquid crystal display apparatus as set forth in claim 1, wherein said rearrangement means, further comprises:

at least two memories for temporarily storing said video data; and data distribution means for distributing said input video data into said at least two memories.

6. A liquid crystal display apparatus as set forth in claim 5, wherein said input video data stored in one of said at least two memories is mutually exclusive with said input video data stored in another of said at least two memories.

7. A liquid crystal display apparatus as set forth in claim 6, wherein a total storage capacity of said at least two memories corresponds to the storage requirements of one line of the input video data.

8. A liquid crystal display apparatus as set forth in claim 5, wherein said at least two memories includes means for simultaneously reading out said input video data from said at least two memories.

9. A liquid crystal display apparatus as set forth in claim 8, wherein a total storage capacity of said at least two memories corresponds to the storage requirements of two lines of the input video data.

10. A liquid crystal display apparatus as set forth in claim 1, wherein said rearrangement means further comprises:

at least two first-in first-out devices connected to each of said first data driver circuit and second data driver circuit; and data distribution means for distributing the input video data from said data lines into said at least two first-in first-out devices.

11. A liquid crystal display apparatus as set forth in claim 1, wherein said plurality of multiplexing circuits are provided on said liquid crystal panel.

12. A liquid crystal display apparatus as set forth in claim 1, wherein said plurality of demultiplexing means and said first and second data driver circuits are provided on said liquid crystal panel.

13. A liquid crystal display apparatus as set forth in claim 1, wherein the first and second data driver circuits are provided on an integrated circuit separate from the liquid crystal panel.

14. A liquid crystal display apparatus as set forth in claim 1, wherein the first and second data driver circuits are provided on an integrated circuit with the liquid crystal panel.

15. A liquid crystal display apparatus, comprising:

a liquid crystal panel in which red, green, and blue picture element cells are arranged at intersections of a plurality of data lines with a plurality of gate lines, the red, green, and blue elements being repeated in horizontal axis thereof;

a first data driver circuit for supplying a plurality of video signals;

a second data driver circuit for supplying a plurality of video signals;

rearrangement means for rearranging a stream of input red, green, and blue video data and supplying the stream of rearranged input video data to the first and second data driver circuits, the stream of the rearranged input video data being different than the stream of the input red, green, and blue video data; and a plurality of demultiplexing circuits each receiving a respective one of the video signals supplied from a respective one of the first and second data driver circuits and selectively outputting the respective video signal to a respective group of said plurality of data lines.

16. A liquid crystal display apparatus as set forth in claim 15, wherein the rearrangement means supplies the rearranged input video data to the first and second data driver circuits via first and second data paths each individually connected to said first and second data driver circuits, respectively.

17. A liquid crystal display apparatus as set forth in claim 16, wherein the rearranged video data on the first path is in a mutually exclusive relationship with the rearranged video data on the second path.

18. A liquid crystal display apparatus as set forth in claim 16, wherein said first and second data paths are simultaneously fed with the rearranged video data from said rearrangement means.

19. A liquid crystal display apparatus as set forth in claim 15, wherein said rearrangement means further comprises:

at least two memories for temporally storing the input red, green, and blue video data; and data distribution means for distributing the video data into said at least two memories.

20. A liquid crystal display apparatus as set forth in claim 19, wherein data stored in one of said at least two memories is mutually exclusive with data stored in another of said at least two memories.

21. A liquid crystal display apparatus as set forth in claim 20, wherein a total storage capacity of said at least two memories corresponds to the storage requirements of one line of the video data.

22. A liquid crystal display apparatus as set forth in claim 19, wherein said at least two memories includes means for simultaneously reading out said video data from said at least two memories.

23. A liquid crystal display apparatus as set forth in claim 22, wherein a total storage capacity of said at least two memories corresponds to the storage requirements of two lines of the video data.

24. A liquid crystal display apparatus as set forth in claim 15, wherein said rearrangement means further comprises:

at least two first-in first-out devices connected to each of said first data driver circuit and second data driver circuit; and data distribution means for distributing the video data from said data lines into said at least two first-in first-out devices.

25. A liquid crystal display apparatus as set forth in claim 15, wherein said plurality of demultiplexing circuits are provided on said liquid crystal panel.

26. A liquid crystal display apparatus as set forth in claim 15, wherein said plurality of demultiplexing means and said first and second data driver circuits are provided on said liquid crystal panel.

27. A liquid crystal display apparatus as set forth in claim 15, wherein the first and second data driver circuits are provided on an integrated circuit separate from the liquid crystal panel.

28. A liquid crystal display apparatus as set forth in claim 15, wherein the first and second data driver circuits are provided on an integrated circuit with the liquid crystal panel.

29. A liquid crystal display apparatus, comprising:

a liquid crystal panel in which picture element cells are arranged at each of a plurality of intersections of n data lines with m gates lines, wherein n and m are positive integers;

a plurality of multiplexing means, n divided by p in number, each said multiplexing means for time divisionally outputting a data signal to p of the n data lines, where p is a positive integer less than n;

data driver circuits q in number, for applying a video signal to the plurality of multiplexing means wherein q is a positive integer; and rearrangement means for rearranging a stream of video data to be supplied for said data driver circuits.

30. A liquid crystal display apparatus, comprising:

a liquid crystal panel including a pixel matrix having at least two color picture elements, a plurality of gate lines and a plurality of data lines disposed on the pixel matrix to apply a video signal to each picture element;

a memory circuit including output buses, the memory circuit receiving data streams for respective color picture elements separately, and data streams on the respective output buses having digital video data corresponding to at least two colors of the picture elements;

a data driver circuit for converting the digital video data into video signals to be applied to the data lines; and a plurality of demultiplexing circuits for time divisionally applying the video signals of the data driver circuit to at least two among the plurality of data lines, respectively.

31. The liquid crystal display apparatus as set forth in claim 30, wherein the pixel matrix has red, green and blue color picture elements.

32. The liquid crystal display apparatus as set forth in claim 30, wherein the data driver circuit is divided into at least two groups connected to the memory circuit by way of respective data paths.

33. The liquid crystal display apparatus as set forth in claim 32, wherein the data paths are differently fed with the digital data from the memory circuit to the at least two driver groups in time.

34. The liquid crystal display apparatus as set forth in claim 32, wherein the data paths are simultaneously fed with the digital data from the memory circuit.

35. The liquid crystal display apparatus as set forth in claim 30, wherein said memory circuit comprises:

at least two memories for temporarily storing the digital video data; and data distributing means for distributing the digital video data into said at least two memories.

36. The liquid crystal display apparatus as set forth in claim 35, wherein read-out operations in said at least two memories are differently performed in time.

37. The liquid crystal display apparatus as set forth in claim 32, wherein said memory circuit comprises:

at least two first-in, first-out devices connected to each of said at least two driver groups; and data distributing means for distributing the digital video data from lines of the digital video data into said at least two first-in, first-out devices.

38. The liquid crystal display apparatus as set forth in claim 30, wherein the data driver circuit is provided on an integrated circuit separate from the liquid crystal panel.

39. The liquid crystal display apparatus as set forth in claim 30, wherein the data driver circuit is provided on an integrated circuit with the liquid crystal panel.

40. The liquid crystal display apparatus as set forth in claim 30, wherein the plurality of demultiplexers are provided on the liquid crystal panel.

* * * * *

UNITED STATES PATENT AND TRADEMARK OFFICE

CERTIFICATE OF CORRECTION

PATENT NO. : 6,333,729 B1
DATED : December 25, 2001
INVENTOR(S) : Yong Min Ha

It is certified that error appears in the above-identified patent and that said Letters Patent is hereby corrected as shown below:

Title page,
Item [57], ABSTRACT,
Line 5, "rearranged" should read -- rearranges --.

Column 11,
Line 55, "firth path" should read -- first path --.
Line 59, "said firth" should read -- said first --.

Column 14,
Line 1, after "circuits", insert a comma.

Signed and Sealed this

Seventeenth Day of September, 2002

*Attest:*

*Attesting Officer*

JAMES E. ROGAN
*Director of the United States Patent and Trademark Office*